US007055355B2

(12) United States Patent
Codatto

(10) Patent No.: US 7,055,355 B2
(45) Date of Patent: Jun. 6, 2006

(54) METHOD AND DEVICE FOR BENDING ELEMENTS, SUCH AS PANELS, METAL SHEET, PLATES OR SUCHLIKE

(76) Inventor: Antonio Codatto, Via della Liberta, 77 - 37047 San Bonifacio (VR) (IT)

( * ) Notice: Subject to any disclaimer, the term of this patent is extended or adjusted under 35 U.S.C. 154(b) by 163 days.

(21) Appl. No.: 10/683,533

(22) Filed: Oct. 10, 2003

(65) Prior Publication Data

US 2004/0103706 A1 Jun. 3, 2004

(30) Foreign Application Priority Data

Oct. 11, 2003 (IT) ..... UD2002A000210

(51) Int. Cl.
*B21D 5/04* (2006.01)

(52) U.S. Cl. ..... 72/31.11; 72/37; 72/307; 72/323

(58) Field of Classification Search ..... 72/31.11, 72/37, 307, 319, 322, 323
See application file for complete search history.

(56) References Cited

U.S. PATENT DOCUMENTS 4,627,255 A * 12/1986 Archer et al. ..... 72/17.3
4,772,801 A 9/1988 Fornerod et al.
4,773,284 A * 9/1988 Archer et al. ..... 76/4
5,461,893 A 10/1995 Tyler et al.
5,839,310 A * 11/1998 Tokai et al. ..... 72/31.1
6,644,080 B1 * 11/2003 Lindstrom ..... 72/19.4

FOREIGN PATENT DOCUMENTS

| | | |
|---|---|---|
| EP | 1 052 034 A2 | 11/2000 |
| JP | 61-129522 A | 6/1986 |
| JP | 08090086 | 9/1996 |
| JP | 11216520 | 10/1999 |
| WO | WO 96/21529 A1 | 7/1996 |

* cited by examiner

*Primary Examiner*—Daniel C. Crane
(74) *Attorney, Agent, or Firm*—Akin Gump Strauss Hauer & Feld, LLP

(57) ABSTRACT

Method and device for bending a portion of an element in a bending machine (12) comprising a bending assembly (14), a supporting plane (18) and an electronic processing unit (32), wherein the bending process is filmed and displayed on a screen (36). The portion (24) is bent with a first movement of the bending assembly (14) to make a first bend of a nominal value. By means of reference indicator elements an angle of deviation is determined and the portion is again bent with a new movement of the bending assembly (14), taking into account the angle of deviation. All movements of the bending assembly (14) are acquired by a position transducer (15) and recorded by the electronic processing unit (32) in order to have a global parameter for obtaining an angle which corresponds to the nominal value, and in order to use the global parameter in subsequent analogous or similar bends.

15 Claims, 4 Drawing Sheets

METHOD AND DEVICE FOR BENDING ELEMENTS, SUCH AS PANELS, METAL SHEET, PLATES OR SUCHLIKE

BACKGROUND OF THE INVENTION

The present invention concerns a method, and the relative device, for bending and shaping, also of the type with a possibly varying radius, at least partly plane elements of a deformable type, such as panels, metal sheet, plates or suchlike, made by means of a bending machine, in order to obtain a panel shaped according to a pre-established design or project.

Bending machines are known by means of which a plane element of deformable type, for example a metal sheet, is bent to obtain a shaped element according to a pre-established project. Conventional machines substantially comprise a supporting plane on which the sheet to be bent is arranged, a sheet-pressing element suitable to clamp on each occasion a segment of the sheet against the supporting plane, and a bending assembly that acts on a free portion of the sheet adjacent to the segment clamped by the aforesaid element.

The bending assembly normally comprises two opposite blades mounted on a blade-bearing element that is driven in one direction or the other according to whether the bend to be made is upwards or downwards.

Conventional machines are also equipped with a system to set the angle of bend that allows to set in advance a sequence of angles of bend to be made according to the project to be made.

One disadvantage of conventional bending machines is the lack of reliable control means that allow to verify that the angle of bend achieved coincides with the pre-set angle of bend. In fact it is known that, after it has been subjected to bending, a segment of sheet tends to return elastically back by a certain angle, and this causes a reduction in the real value of the angle of bend with respect to the angle set.

The elastic return, to be more exact, is a variable that depends on many parameters, for example the size and thickness of the sheet, the intrinsic elasticity, the mechanical resistance, the production lot, the value of the angle of bend, environmental conditions, and others.

To be able to correct the deviation of the actual value from the project value, at least the first sheet bent must therefore be removed from the machine, to measure the actual value of bending, and then returned to the machine to perform the bending. In the case of particular or difficult bends, it often happens that some first panels must be eliminated because they are incorrectly bent in a way that cannot be remedied.

Such systems therefore have the disadvantage that they require burdensome and complex operations to obtain a precision bending, which entails a loss of time, longer processing times and additional costs, especially in the case where a sequential processing of sheets of different elasticity and thickness is intended.

There are also visual systems that provide to record the bending zone to verify deviations with respect to the project angle, but such systems are of an artisan nature and rely on the ability and experience of the operator.

For example, an optical light beam device for automatically controlling the bending operation when bending with a press brake is known from U.S. Pat. No. 4,772,801. Such optical light beam device comprises an emitter, mounted on one side of the press, adapted to produce a large-diameter light beam, directed parallel to the bending axis of the workpiece to be bent, and a receiver comprising a screen drilled with a plurality of holes arranged to forming a plurality of light beams of small diameters. A microordinator is connected to the receiver and permits the determination of the instantaneous bending angle of the workpiece and the control of the descent of the punch.

WO 96/21529, on which the preamble of claims 1 and 11 is based, also discloses a profile definition system for use with profile bending apparatus using an imaging process. A profile such as that used to form a cutting knife is located above a non-reflective surface such that the profile configuration can be imaged through a camera substantially mounted above it. The camera image is captured by a frame grabber device such that the profile configuration can be compared in comparator means with a desired profile shape. Dependent upon the comparison further profile strip feed and/or bend operations may be performed in order to bring into substantial agreement the actual strip profile and the desired strip profile.

However, both documents cited disclose systems which permit only to calculate a bending angle correction and operate the bending machine accordingly in order to match the actual shape and the required shape of the bent element. Neither of these documents discloses or suggests any systems able to acquire, for each bending operation, data related to the offsets between the bend made and the bend required for influencing the driving of the bending device so as to obtain the desired values of the bend to be made automatically, and without any human intervention.

Moreover, in both documents, after each bending step the element being bent is completely released by the bending assembly, so that it is impossible to guarantee a reliable reference for the next bends to be made.

The present Applicant has devised and embodied this invention to overcome the shortcomings of the state of the art, and to obtain other advantages.

BRIEF SUMMARY OF THE INVENTION

The present invention is set forth and characterized essentially in the main claims, while the dependent claims describe other innovative characteristics of the invention.

The purpose of the invention is to perfect a bending method, and to achieve a corresponding device, which provides at least a control step during which the correspondence is verified between the actual value of the angle of bend and the relative pre-established project value, or reference value; moreover, during the control step, the deviation due to elastic return is quantified, both to correct the bending error, and also to use this information for subsequent cycles of bending.

Another purpose of the present invention is to obtain a bending device by means of which it is possible to make any type of bending automatically, with great precision and accuracy, and without the need of any continuous control and comparison to be made by an operator after each bending.

In accordance with these purposes, a method according to the invention for bending a portion of an element provides that said portion be bent by driving a bending assembly under the control of an electronic processing unit associated with a position transducer. The electronic unit communicates with the transducer and allows to establish a univocal correlation between the movement of the bending assembly and the commands imparted to the same assembly.

The method also provides that the bending is recorded by image acquisition means, which send the image relating to the bending to display means, such as a screen, a video or suchlike, which display a system of coordinates including at least a reference axis coinciding with the supporting plane of the element to be bent.

According to the invention, at the start of bending, a graphic indicator is positioned on the screen, for example a nominal straight line, angled with respect to the reference axis by a value coinciding with the angle to be obtained.

During bending, the screen displays the position of the element being worked, and the bending assembly is driven until a first alignment is obtained, for example as observed by the operator, between the bent portion and the nominal straight line. According to a variant, the machine automatically signals when this alignment has been achieved.

The electronic processing unit, by means of the position transducer, acquires and records the command parameters with which the bending assembly has been driven to reach this alignment.

When the bending assembly is released, the bent portion is subject to elastic return and the angle of bend is modified for a given value, defined as angle of deviation.

The electronic unit calculates in the reference system the value of the angle of deviation.

The bending assembly is then repositioned to act on the bent portion.

The amount of the movements of the bending assembly for its repositioning is recorded by the electronic processing unit by means of the position transducer, for example in terms of reduction with respect to the movement of the bending assembly imparted to make the first bend.

The subsequent step provides that the nominal straight line is positioned in a new reference position, which takes into account the aforesaid angle of deviation.

The element is then subjected to a second bending until alignment with the nominal straight line in this new position is reached. Here too, the verification of the alignment can be only visual or automated.

The movement imparted to the bending assembly to make the second bend is also recorded by the electronic processing unit.

Moreover, since the electronic processing unit has already taken into account the angle of deviation, when the bending assembly is released the bent portion moves elastically into the position coinciding with the nominal position to be obtained.

Thanks to the position transducer, the electronic processing unit is thus able, by recording each command imparted to the bending assembly and algebraically adding together on each occasion the values of movement of the bending assembly, to acquire a global parameter necessary to obtain an angle which, taking into account the angle of deviation for that sheet and that angle of the first bend, exactly and univocally corresponds to the nominal value to be obtained. In this way the information can be used to automatically bend subsequent elements, or for analogous bends on the same element, without the need of any continuous control and comparison by an operator after each bending.

The value of the angle of deviation can be calculated in various ways.

A first solution provides that a virtual straight line, aligned with the bent portion, is generated on the screen on each occasion, and that the angle between said virtual straight line and the nominal straight line is calculated automatically.

Another solution provides that the system of coordinates on the screen is divided into a plurality of angular sectors to each of which a determinate range of values of angles to the reference axis is attributed. In this way, by displaying the position of the bent portion, the angle is obtained as a function of the angular sector in which the portion is located.

In yet another solution, the nominal straight line is displaced until it aligns with the bent portion and the angle of deviation performed is calculated.

In a preferential form of embodiment, the bending assembly is driven manually by means of an impulse-type command, wherein an angle of partial bending, as acquired by the position transducer, corresponds to every impulse. The electronic processing unit, during the bending, algebraically adds together the total number of impulses, positive and negative, that is with a deviation in one direction or the other of the bending assembly, needed to actually obtain the value of the nominal angle with the steps described above.

According to a variant, all the drives of the bending assembly are performed automatically according to commands imparted by the electronic processing unit.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. These and other characteristics of the present invention will become apparent from the following description of a preferential form of embodiment, given as a non-restrictive example, with reference to the attached drawings wherein.

In the drawings.

DETAILED DESCRIPTION OF THE INVENTION

Figure 1:
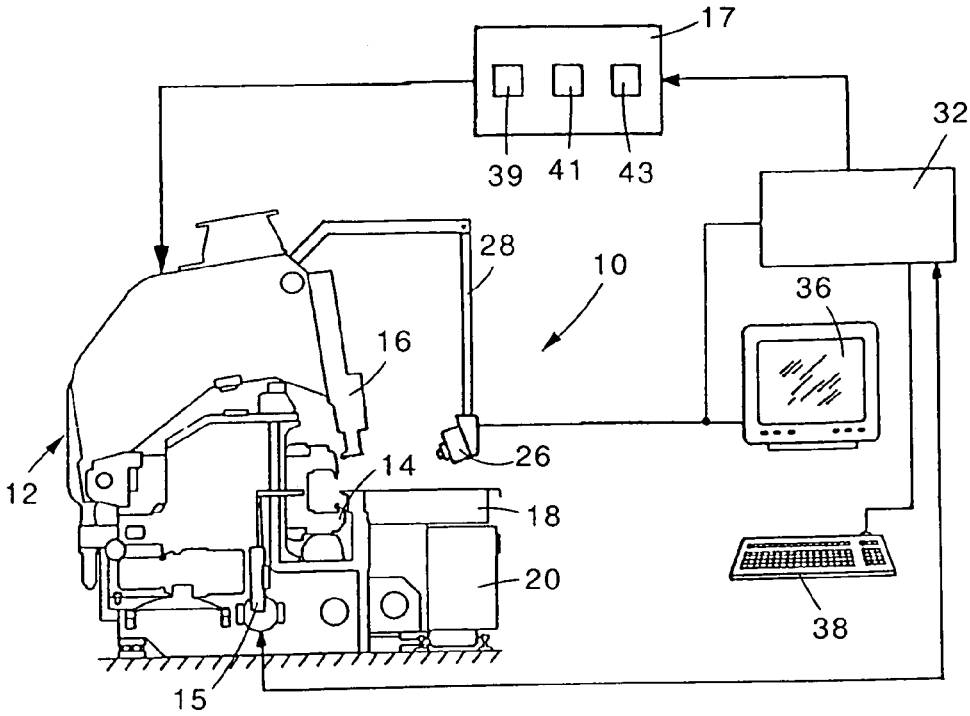
FIG. 1 is a schematic view of the device according to the present invention.
Figure 2:
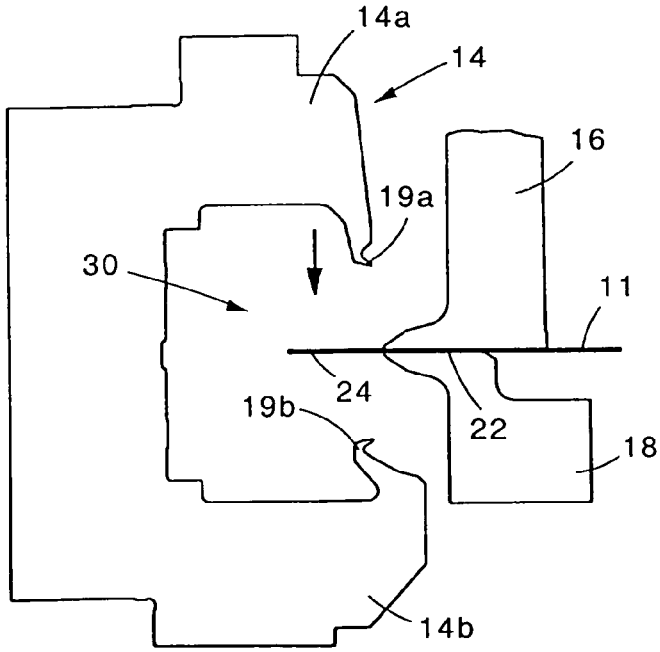
FIG. 2 shows a detail of FIG. 1 in a first operating condition.

With reference to FIGS. 1 and 2, a device 10 for bending a metal sheet 11 according to the present invention comprises a bending machine 12 of a conventional type. The machine 12 comprises at least a bending assembly 14, a sheet-pressing arm 16 and a supporting plane 18, substantially horizontal, which is mounted on a movable trolley 20 to be displaced linearly with respect to the bending machine 12 in a right-left or backwards-forwards movement, according to the bends to be made.

The bending assembly 14 is movable vertically, has a substantially C-shaped profile in order to accommodate inside itself the sheet 11 and comprises two blades, upper 14*a* and lower 14*b*, each of which is provided at one end with a shaped element 19*a*, 19*b* able to act on a free portion 24 of the sheet 11.

The bending assembly 14 is also associated with a position transducer 15, for example a linear or rotational encoder, connected to an electronic processing unit 32, for example of the microprocessor type.

The electronic processing unit 32 is also connected to an actuation assembly 17 that commands the controlled drive of the bending assembly 14, according to the design specifications, in order to obtain on each occasion a particular nominal angle of bend γ (FIG. 4); in this case, the portion 24 is bent downwards.

The actuation assembly 17 is provided, in this case, with commands for three functions, respectively a first command 39 for the upward movements of the bending assembly 14, a second command 41 for the downward movements and a third command 43 to release the bending assembly 14.

Figure 3:
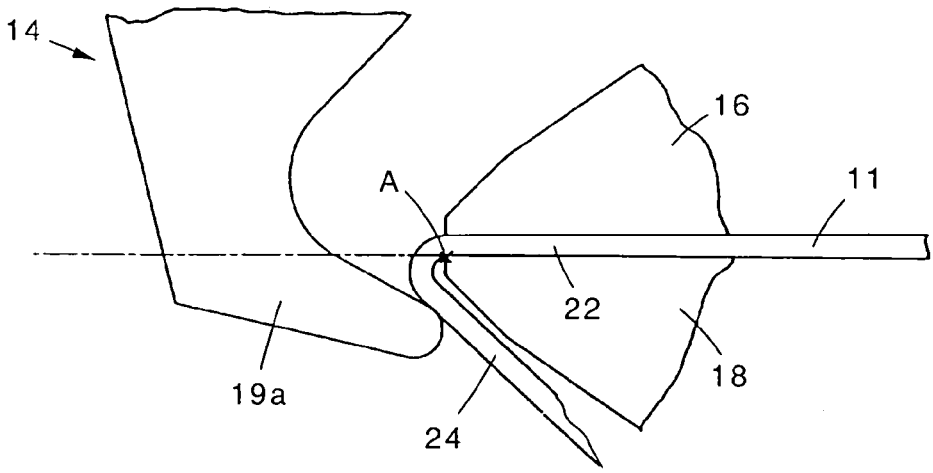
FIG. 3 shows a detail of FIG. 2 in a second operating condition.

Before starting the bending action (FIGS. 2 and 3), the sheet-pressing arm 16 is lowered onto the supporting plane 18 to clamp the sheet 11 in correspondence with a segment 22 adjacent to the free portion 24; this clamped position is maintained throughout the bending operation.

Then, the upper blade 14*a* is lowered until the relative shaped element 19*a* presses against the portion 24 to perform the bending.

The device 10 also comprises a TV camera 26, for example of the digital type, connected to the electronic processing unit 32, which is mounted on an articulated supporting arm 28 to film a bending zone 30 defined between the bending assembly 14, the sheet-pressing arm 16 and the supporting plane 18. The TV camera 26 is advantageously positioned substantially in line with the bending axis A (FIG. 3), in order to be able to film the sheet 11 laterally and hence the angle of bend.

The TV camera 26 sends the images relating to the bending to the electronic processing unit 32, in order to allow a visual control thereof on a screen 36, advantageously on enlarged scale.

On the screen 36 (FIGS. 4–7), according to the invention, a system of reference coordinates is displayed, including a reference axis X, in this case substantially horizontal, coinciding with the supporting plane 18 of the element 11 to be bent. Moreover, at the start of bending, on the screen 36 a nominal straight line Z is positioned, whose angle with respect to the reference axis X coincides with the nominal angle γ to be obtained.

During bending, the image of the portion 24 during working is displayed on the screen 36.

Figure 4:
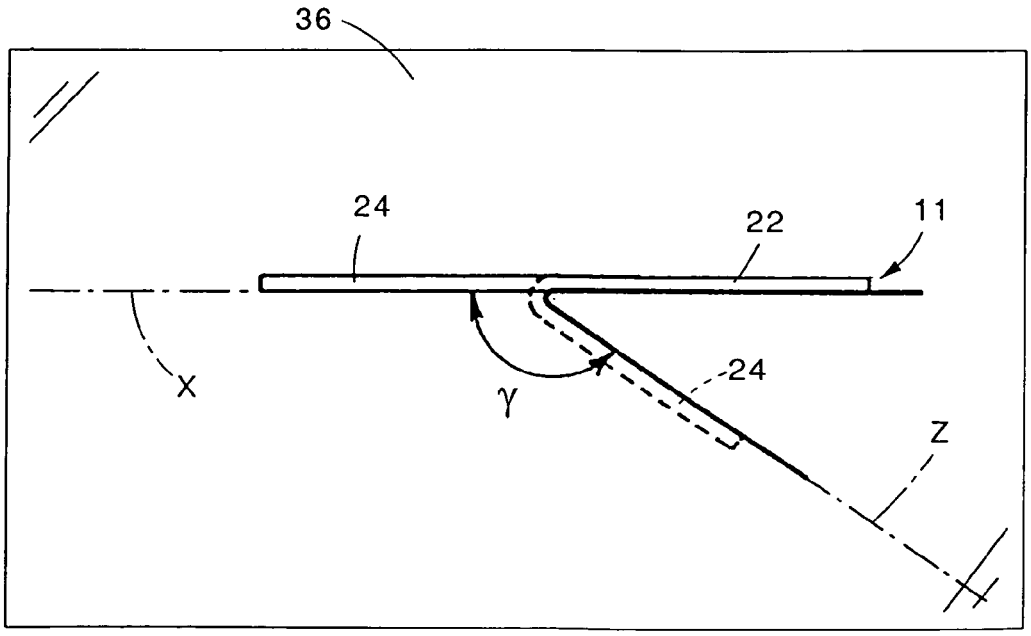
FIGS. 4–7 show schematically the steps of the method according to the invention.
Figure 5:
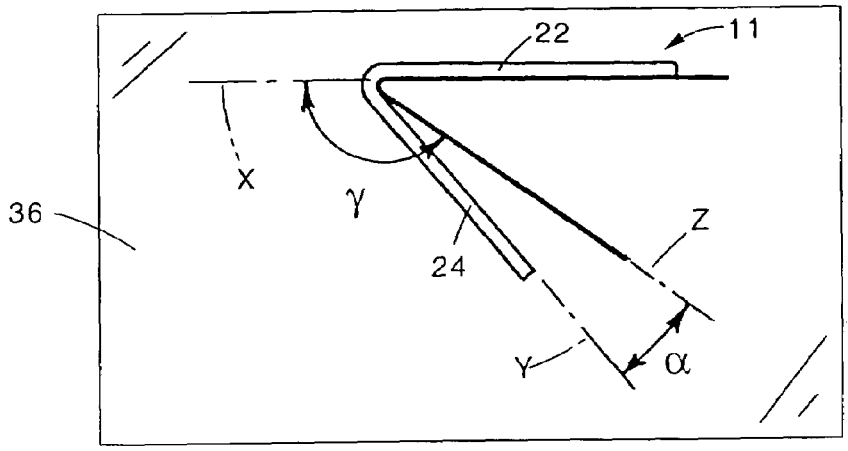
Figure 6:
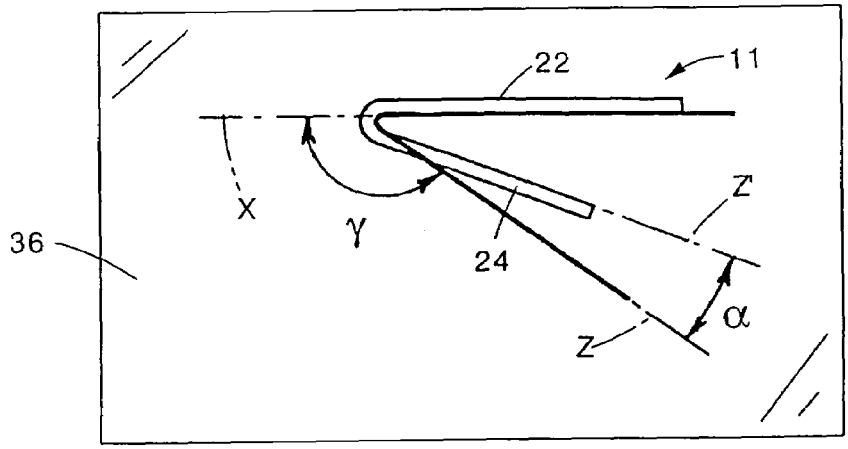
Figure 7:
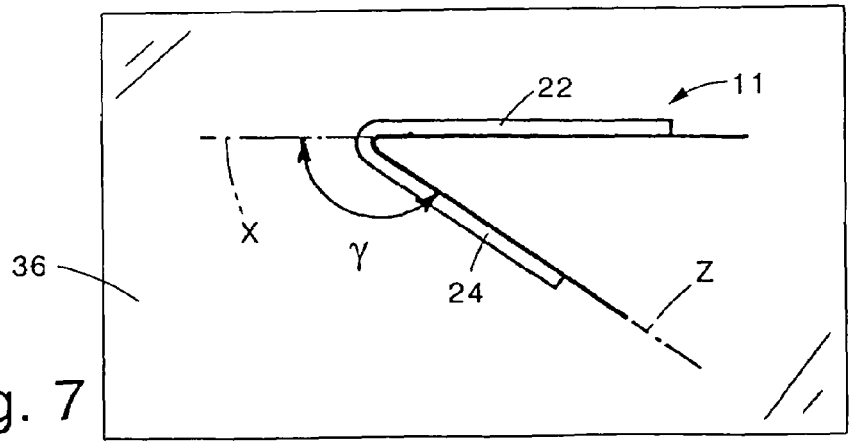
Figure 8C:
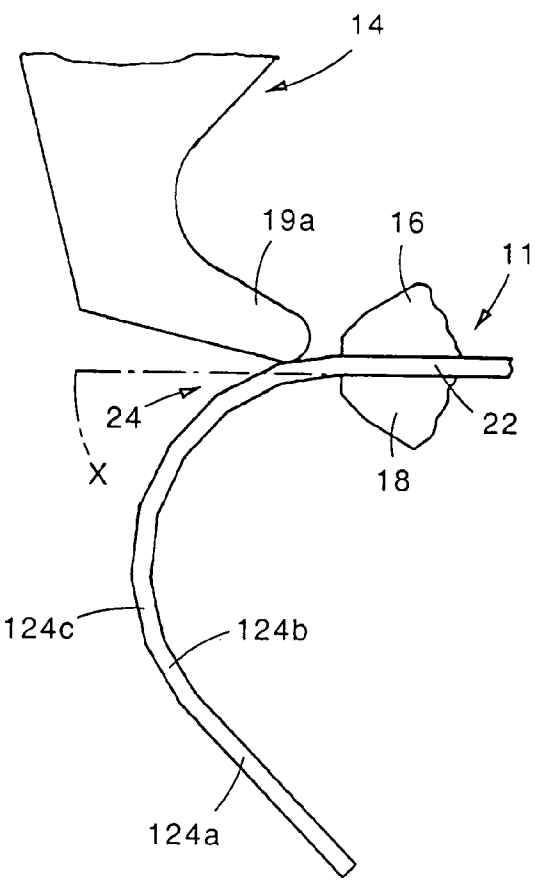
FIGS. 8*a*, 8*b* and 8*c* show schematically the method according to the invention to obtain a curve of the type with a possibly varying radius.
Figure 8B:
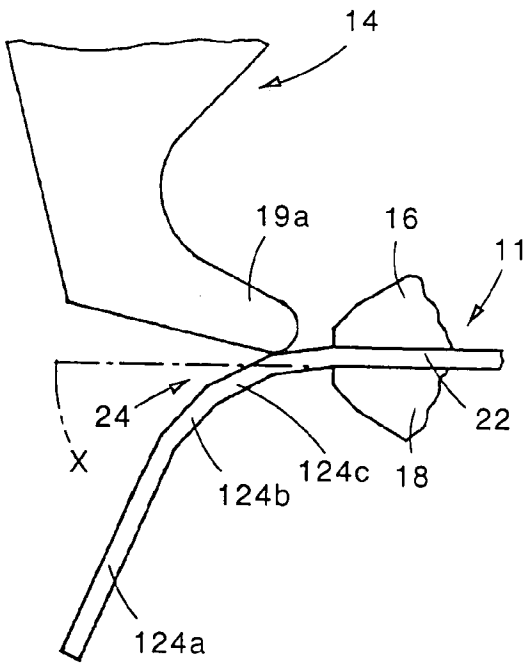
Figure 8A:
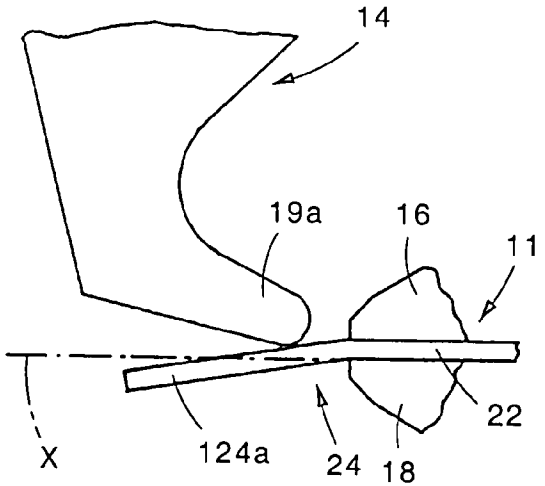

The bending assembly 14 is driven, by acting in this case on the command 41, until alignment is obtained, verified visually, of the bent portion 24 with the nominal straight line Z, as shown with a line of dashes in FIG. 4.

According to a variant, the electronic processing unit 32 signals automatically that the alignment has been achieved.

The bending assembly 14 is driven, in a preferential embodiment, by acting with impulses on the command 41, or 39, wherein for every impulse a fraction of the angle of bend γ is performed. The electronic processing unit 32, by means of the connection with the transducer 15, records the total number of impulses imparted to the bending assembly 14 to reach the aforesaid alignment.

In one embodiment of the invention, the bending assembly 14 is driven continuously until the portion 24 is at a certain distance from the position of the nominal straight line Z and then it is brought progressively closer by means of impulses in order to prevent the nominal angle to be obtained from being exceeded.

When the alignment between the portion 24 and the nominal straight line Z has been verified, the bending assembly 14 is released, by acting on the command 43 of the actuation assembly 17. The sheet-pressing arm 16 is kept pressed on the sheet 11 in order to guarantee a safe and reliable reference. The bent portion 24, left free, is thus subject to an elastic return (FIG. 5), for a set angle of deviation α.

The value of the angle of deviation α can be calculated by the electronic processing unit 32, for example by locating a virtual straight line Y in correspondence with the new position of the bent portion 24 and measuring the angle between the straight lines Y and Z.

When the bending assembly 14, by acting on the command 39, is repositioned on the sheet 11, in this case it is displaced upwards, to perform the correction to the bending, this movement is acquired by the transducer 15, and correlated by the electronic unit 32 to a set number of impulses, in this case negative.

The negative impulses are subtracted from the number of impulses necessary for the first movement downwards of the bending assembly 14.

The nominal straight line is then positioned in correspondence with a second reference position Z', corresponding to an angle equal to γ+α (FIG. 6), in order to compensate in advance the elastic deviation α.

The bending assembly 14 is returned onto the sheet 11 and a new bend is made until the portion 24 is aligned with the reference straight line Z'. The electronic unit 32 again records, in terms of increase in impulses, the downward movement of the bending assembly 14, thus obtaining the definitive and global value of impulses with which it is necessary to drive said assembly 14 in order to obtain the desired angle of bend γ, which already takes into account the specific angle of deviation α.

In this way, when an identical bend has to be made on the same sheet 11, or on a different sheet but with the same parameters such as size, mechanical resistance, elasticity, the bending can be done simply by setting the number of impulses calculated for the first sheet 11, which guarantees absolute precision and repeatability of the operation.

The method described above can also be used for a so-called bend with a possibly varying radius, wherein on the same portion 24 a series of consecutive bends are made. In this case, each bend is made on a plurality of consecutive segments 124*a*, 124*b*, 124*c* . . . of the sheet to obtain a curve with a particular radius.

In this case, for the first segment 124*a*, which is bent starting from the plane sheet 11, the procedure as described above is carried out, which leads to calculate the angle of deviation and to count the impulses in order to obtain the pre-established angle of bend.

For the subsequent segment 124*b*, wherein the bending conditions can be different since bending starts from a portion 24 that is not plane, the complete procedure of verification and control can be repeated; on the contrary, the other segments 124*c*, etc. can be bent automatically according to the number of impulses previously calculated, possibly entrusting the actual collimation of the bent portion and reference straight lines to a visual verification on the screen 36, or an automatic verification.

Modifications and variants may be made to the present invention, all of which shall come within the field of the following claims.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. Method for bending a portion (24) of an element (11) in a bending machine (12), comprising at least a bending assembly (14), a supporting plane (18) on which said element (11) is retained by an arm (16), and an electronic processing unit (32), wherein the bending process is filmed by image acquisition means (26) and displayed on display means (36), the method comprising a step of setting a nominal value ("γ") of the angle of bend to be obtained, characterized in that it provides that:

the arm (16) is kept pressed on a segment (22) of said element (11) adjacent to said portion (24) during the whole bending cycle in order to guarantee a safe reference;

a movement of the bending assembly (14) to make said first bend is acquired by a position transducer (15) and recorded by said electronic processing unit (32);

a first reference indicator ("Z") is positioned on said display means (36), with respect to a reference axis ("X") aligned with said supporting plane (18), to make a first bend of a nominal value ("γ");

the value of an angle of deviation ("α") is determined, caused by an elastic return of said bent portion (24) and a second reference indicator ("Z'") is positioned, wherein the angle of deviation ("α") is taken into account;

the portion (24) is bent with a new movement of said bending assembly (14) until the portion aligns with the second reference indicator ("Z'");

the new movement of said bending assembly (14) is acquired by said position transducer (15) and recorded by said electronic processing unit (32) in order to have a global parameter for obtaining an angle which, taking into account the value of the angle of deviation ("α") for that element (11) and of the angle of said first bend, corresponds univocally to said nominal value (γ), and in order to use said global parameter in subsequent analogous or similar bends.

2. Method as in claim 1, characterized in that the drive of said bending assembly (14) is carried out manually by means of commands (39, 41, 43).

3. Method as in claim 1, characterized in that the drive of said bending assembly (14) is carried out automatically on commands of said electronic processing unit (32).

4. Method as in claim 1, wherein said bending assembly (14) is driven, at least partially, by means of an impulse command, wherein an angle of partial bending, as acquired by said position transducer (15), corresponds to each impulse, characterized in that said electronic processing unit (32), during bending, algebraically adds together the total number of impulses, positive and negative, that is, with a deviation in one direction or the other of the bending assembly (14), necessary to actually obtain the value of said nominal angle ("γ").

5. Method as in claim 4, characterized in that the drive of the bending assembly (14) is carried out continuously until said bent portion (24) is at a certain distance from the position of said first reference indicator (Z) and then is brought progressively closer by means of impulses in order to prevent the nominal angle (γ) to be obtained from being exceeded.

6. Method as in claim 1, characterized in that the alignment between the bent portion (24) and the reference indicators ("Z, Z'") is visually verified on each occasion on said display means (36).

7. Method as in claim 1, characterized in that the alignment between the bent portion (24) and the reference indicators ("Z, Z'") is signaled automatically.

8. Method as in claim 1, characterized in that the calculation of said angle of deviation ("α") provides that on said display means (36) a virtual straight line (Y) is generated on each occasion aligned with said bent portion (24), and that the angle is calculated between said virtual straight line (Y) and the first reference indicator ("Z").

9. Method as in claim 1, characterized in that the calculation of said angle of deviation ("α") provides that on said display means (36) a system of coordinates is displayed, divided into a plurality of angular sectors to each of which is attributed a range of values of angles with respect to a reference axis ("X"), and that, displaying the position of said bent portion (24), the angle of deviation ("α") is obtained as a function of the angular sector in which the portion (24) is located.

10. Method as in claim 1, characterized in that the calculation of said angle of deviation ("α") provides that the reference indicator ("Z") is displaced until it aligns with the position of the bent portion (24) and the angle of deviation made is calculated.

11. Device for bending a portion (24) of an element (11) comprising a bending machine (12) including at least a bending assembly (14), a supporting plane (18) on which said element (11) is retained, an electronic processing unit (32), image acquisition means (26) able to film the bending process, and display means (36) able to display said images, characterized in that it comprises:

a pressing arm (16) for pressing on a segment (22) of the element (11) adjacent to said portion (24) during the whole bending cycle in order to guarantee a safe reference;

setting means, able to set on said display means (36) a first reference indicator ("Z") angled, with respect to a reference axis ("X") aligned with said supporting plane (18), by an angle correlated to a nominal angle ("γ") to be obtained;

a position transducer (15), associated with said bending assembly (14), able to acquire the movement of said bending assembly (14) for the alignment of said portion (24) by a first bend with said first reference indicator ("Z"), said position transducer (15) being connected to said electronic processing unit (32) for the recording of said movement;

means to calculate the angle of deviation ("α") caused by the elastic return of the bent portion (24) in order to position a second reference indicator ("Z'") in a position that takes into account said angle of deviation ("α");

said position transducer (15) and said electronic processing unit (32) are able respectively to acquire and to record a new movement imparted to said bending assembly (14) to align said portion (24) with said second reference indicator ("Z'"), in order to have a global parameter for obtaining an angle which, taking into account the value of the angle of deviation ("α") for that element (11) and of the angle of said first bend, corresponds univocally to said nominal value (γ) and in order to use said global parameter in subsequent analogous or similar bends.

12. Device as in claim 11, characterized in that said image acquisition means (26) consist of at least a TV camera (26) facing in the direction of the bending axis (A).

13. Device as in claim 11, characterized in that said bending assembly (14) is associated with an actuation assembly (17) having the commands (39, 41, 43) for drive functions of said bending assembly (14), at least part of said commands being associated with said position transducer (15) in order to find the parameters relating to said drive of the bending assembly (14).

14. Device as in claim 13, characterized in that at least part of said commands (39, 41) are able to command said drive of said bending assembly (14) according to impulses, each impulse corresponding, as acquired by said position transducer (15), to a fraction of an angle.

15. Device as in claim 14, characterized in that said electronic processing unit (32) is able to algebraically add together the command impulses of said bending assembly (14) necessary to obtain the desired angle of bend ("γ"), to record the value of said sum and to use said value for subsequent analogous or similar bends.

* * * * *